US011590724B2

(12) United States Patent
Greenwell

(10) Patent No.: US 11,590,724 B2
(45) Date of Patent: Feb. 28, 2023

(54) PAPER CRUMPLING MACHINE

(71) Applicant: BLUEGRASS BUSINESS PRODUCTS, INC., Bradenburg, KY (US)

(72) Inventor: Owen Patrick Greenwell, Brandenburg, KY (US)

(73) Assignee: Bluegrass Business Products, Inc., Brandenburg, KY (US)

( * ) Notice: Subject to any disclaimer, the term of this patent is extended or adjusted under 35 U.S.C. 154(b) by 664 days.

(21) Appl. No.: 16/558,734

(22) Filed: Sep. 3, 2019

(65) Prior Publication Data

US 2020/0139661 A1 May 7, 2020

Related U.S. Application Data

(60) Provisional application No. 62/725,954, filed on Aug. 31, 2018.

(51) Int. Cl.
*B31D 1/00* (2017.01)
*B31D 5/00* (2017.01)

(52) U.S. Cl.
CPC .... *B31D 5/0052* (2013.01); *B31D 2205/0023* (2013.01); *B31D 2205/0082* (2013.01)

(58) Field of Classification Search
CPC ..... B31D 1/00; B31D 5/0039; B31D 5/0043; B31D 5/0052
See application file for complete search history.

(56) References Cited

U.S. PATENT DOCUMENTS

| | | | | |
|---|---|---|---|---|
| 3,509,797 | A | 5/1970 | Johnson | |
| 3,921,506 | A * | 11/1975 | Hollis | B31D 5/0073 493/22 |
| 4,016,805 | A * | 4/1977 | Hollis | B26D 5/22 493/217 |
| 5,203,761 | A | 4/1993 | Reichental | |
| 5,593,376 | A | 1/1997 | Armington | |
| 5,730,696 | A | 3/1998 | Simmons | |
| 6,015,374 | A | 1/2000 | Murphy | |
| 6,217,498 | B1 | 4/2001 | Simmons | |
| 6,273,360 | B1 | 8/2001 | Robinson | |
| 6,503,182 | B2 * | 1/2003 | Toth | B31D 5/0047 493/233 |
| 7,651,455 | B2 * | 1/2010 | Yampolsky | B26F 1/22 493/464 |
| 8,177,701 | B2 | 5/2012 | Kung | |
| 8,419,606 | B2 | 4/2013 | Carlson | |
| 8,435,165 | B2 | 5/2013 | Bock | |
| 8,550,971 | B2 | 10/2013 | Chan | |
| 8,696,345 | B2 | 4/2014 | Sprick-Schutte | |
| 8,708,882 | B2 | 4/2014 | Chan | |
| 8,997,440 | B2 | 4/2015 | Carlson | |
| 9,370,914 | B2 | 6/2016 | Demers | |
| 9,676,586 | B2 | 6/2017 | Cheich | |
| 9,694,554 | B2 | 7/2017 | Mulvey | |
| 2007/0066472 | A1 | 3/2007 | Harding | |
| 2007/0117703 | A1 | 5/2007 | Cavaliere | |
| 2008/0098699 | A1 | 5/2008 | Cheich | |

* cited by examiner

*Primary Examiner* — Praachi M Pathak
(74) *Attorney, Agent, or Firm* — Carrithers Law Office PLLC

(57) ABSTRACT

A machine for pulling paper off of a roll and crumpling the paper increasing the surface area and bulk of the compressible crumpled paper. The crumpled paper is used as packing material, cushioning packaged parts and filling package voids.

15 Claims, 6 Drawing Sheets

PAPER CRUMPLING MACHINE

CROSS REFERENCES TO RELATED APPLICATIONS

This application claims priority from U.S. Provisional Application Ser. No. 62/725,954 filed on Aug. 31, 2018 which is incorporated by reference in its entirety.

TECHNICAL FIELD

The present invention relates to the field devices used to crumple paper which is pulled from a roll and then used as filler and cushioning around objects being packaged in boxes.

BACKGROUND OF THE INVENTION

Products to be stored or delivered are generally packaged in a box or other type of container. Normally, a given product does not fit perfectly with in the box some sort of packing material is needed to fill voids and otherwise cushion the product within the box. The packing material used to fill void space within a container is typically a lightweight, air-filled material that may act as a pillow or cushion to protect the product within the container. Frequently, a plastic bubble material is used to protect and cushion the product contained within a container. However, plastic bubble material can be expensive and time-consuming to produce. Further, plastic bubble material is not form fitting and in many instances, voids are still present within a 'filled' package. Still further, plastic bubble material is not "environmentally friendly" in that these materials are not readily biodegradable when exposed to the environment.

Small Styrofoam pellets or "peanuts" may also be used to fill voids within containers for protecting and cushioning a product within those containers during transport. Again, such styrene packing is not environmentally friendly. Packing material made from paper is biodegradable, highly flexible in terms of use, and is comparably inexpensive.

U.S. Pat. No. 7,744,519 for SYSTEM AND METHOD FOR CRUMPLING PAPER SUBSTRATES by Wetsch et al which issued on Jun. 29, 2010 teaches a machine which crumples paper pulled from a roll of paper. The machine includes a motor driven drive roller with an idling pressure roller, an additional 'guide' roller, a wire-form feed chute and a braking system for the paper roll including 'tapered caps' which support the roll from inside but do not rotate, causing the roll's inner core to slide on the caps, thus providing braking friction, and further braking is provided by a strut with a curved surface which can contact the roll to impede rolling action.

SUMMARY OF THE INVENTION

In accordance with the present invention, there is provided a paper crumpling machine for crumpling paper pulled from a roll comprising, consisting of, or consisting essentially of a floor stand with a first vertical pedestal on the left side supporting a paper crumpler and a second vertical pedestal on the right side supporting a paper roll cradle. The first pedestal supports a paper crumpler about five feet above the floor stand. The paper crumpler has a front side, a back side, a left side and a right side. The paper crumpler has an feed horn on the right side having a rectangular feed opening about six inches wide and about four inches high. The feed opening is smooth and curved. The feed horn has an exit opening about five inches wide and about one inch high. The exit opening faces left and leads into and between a driven horizontal roller and a first horizontal idler roller. The driven roller is fixed on an output shaft of a motor. The first idler roller is rotatably connected to a rocker plate which is rotatably connected to the bottom surface of a pressure plate. The left end of the pressure plate is rotatably connected to a vertical back plate of the paper crumpler. The right end of the pressure plate is connected to the first end of an extension spring. The second end of the extension spring extends to the right and downward about fifteen degrees and is connected to a pin extending from the back plate. The spring is tensioned to apply paper pulling force from the first idler roller against the driven roller. The rocker plate having a second horizontal idler roller rotatably connected thereto and pressing against the driven roller. The first and the second idlers spaced apart on the rocker plate with the first idler roller contacting the driven roller at about 1:30 (the angle made by the minute hand on an analog watch at the hour of one thirty) with respect to the driven roller and the second idler contacting the driven roller at about 9:00 with respect to the driven roller. The rocker plate including a diverter plate extending end to end from the first idler roller toward the second idler roller. The driven roller, the first idler roller and the second idler roller being about seven inches wide. The paper crumpler having an outfeed horn to the left of the driven roller, an opening of the outfeed horn facing between the driven roller and the second idler roller, an feed end of the outfeed horn about seven inches wide and about one inch high, and the outfeed end of the outfeed horn about seven inches wide and about three inches high. The motor is attached on the rear side of the back plate. A motor controller is attached to the rear side of the back plate. The motor controller has a power on switch, a speed select switch, a paper feed switch, and a foot feed switch electrically connected thereto. The second vertical pedestal has a paper roll cradle fixed thereto comprising a first contrasting plate extending outward to the right from a top edge of the second pedestal at an angle of about sixty degrees above horizontal, a second plate extending outward to the left from a top edge of the second pedestal at an angle of about fifteen degrees above horizontal and a horizontal paper roll support roller. The horizontal paper roll support roller is affixed thereto about one inch above an inside surface of the second plate and parallel to the first and the second plates. The paper roll support roller is spaced about five inches from the first plate. The feed horn has an feed paper guide plate connected thereto. The feed paper guide hangs down from the feed horn and guides paper into the feed horn. The feed paper guide curves and extends into the path of feed paper flow thereby providing frictional dampening against a bottom surface of feeding paper, especially when the motor is topped and the paper decelerates.

The paper crumpling machine comprises a floor stand with a first vertical pedestal on a left side and a second vertical pedestal on a right side. The first pedestal supports a paper crumpler about five feet above the floor stand, the paper crumpler having a front side, a back side, a left side and a right side. The paper crumpler has an feed horn on the right side having a rectangular feed opening about six inches wide and about four inches high with an opening having a smooth and curved entry. An exit opening of the feed horn forms a funnel about five inches wide and about one inch high. The exit opens facing left and leads into and between a driven horizontal roller and a first horizontal idler roller. The driven roller is fixed on an output shaft of a motor and the first idler roller rotatably connects to a rocker plate. The rocker plate rotatably connects to the bottom surface of a pressure plate. A left end of the pressure plate rotatably connects to a vertical back plate of the paper crumpler. A right end of the pressure plate connects to a first end of an extension spring and a second end of the extension spring extends to the right and downward about fifteen degrees connecting to a pin extending from the back plate. The spring is tensioned to apply a selected paper pulling force from the first idler roller against the driven roller. The rocker plate has a second horizontal idler roller rotatably connected thereto pressing against the driven roller. The first and the second idlers are spaced apart on the rocker plate with the first idler roller contacting the driven roller at a clock dial position of about 1:30 with respect to the driven roller and the second idler contacting the driven roller at a clock dial position of about 9:00 with respect to the driven roller. The rocker plate includes a diverter plate extending end to end from the first idler roller toward the second idler roller. The driven roller, the first idler roller and the second idler roller are about seven inches wide. The paper crumpler has an product exit horn positioned to the left of the driven roller. An opening of the product exit horn faces between the driven roller and the second idler roller. A feed opening of the paper feed horn is about seven inches wide and about one inch high and the product exit horn is about seven inches wide and about three inches high in order to accommodate the expanded dimensions and volume of the crumpled paper product. The motor is attached on a rear side of the back plate and a motor controller is attached to the rear side of the back plate The motor controller has a power on switch, a speed select switch, a paper feed switch, and a foot feed switch electrically connected thereto. The second vertical pedestal has a paper roll cradle fixed thereto comprising a first contrasting plate extending outward to the right from a top edge of the second pedestal at an angle of about sixty degrees above horizontal. A second plate extends outward to the left from a top edge of the second pedestal at an angle of about fifteen degrees above horizontal. The cradle has a horizontal paper roll support roller affixed thereto about one inch above an inside surface of the second plate and parallel to the first and the second plates. The paper roll support roller is spaced about five inches from the first plate. The feed horn has an feed paper guide plate connected thereto. The feed paper guide hangs down from a bottom edge of the feed horn and guides paper into the feed horn. The feed paper guide curves upward into a path of feed paper flow and provides frictional dampening against a bottom surface of the feeding paper.

It is an object of this invention to provide a paper crumpling machine which pulls paper from a roll, crumples the paper and feeds the crumpled paper out.

It is an object of this invention to provide a paper crumpling machine which pulls paper from a roll and wherein the paper is pulled through an feed horn which has a rectangular opening with smooth edges and the opening necks down gently to a smaller rectangular output aperture.

It is an object of this invention to provide a paper crumpling machine which crumples paper at a continuously variable speed which is selected by positioning a rotary dial.

It is an object of this invention to provide a paper crumpling machine wherein the paper is captured between one drive roller and two idler rollers which provide the needed friction to pull the paper.

It is an object of this invention to provide a paper crumpling machine which is controlled by either a push button paper feed switch or a foot switch.

It is an object of this invention to provide a paper crumpling machine wherein the roll of paper is cradled between a free rolling roller and a planar surface whereby the friction between the planar surface and the roll of paper serves to keep the roll speed under control and prevent the roll from feeding out loose paper while coasting to a stop.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
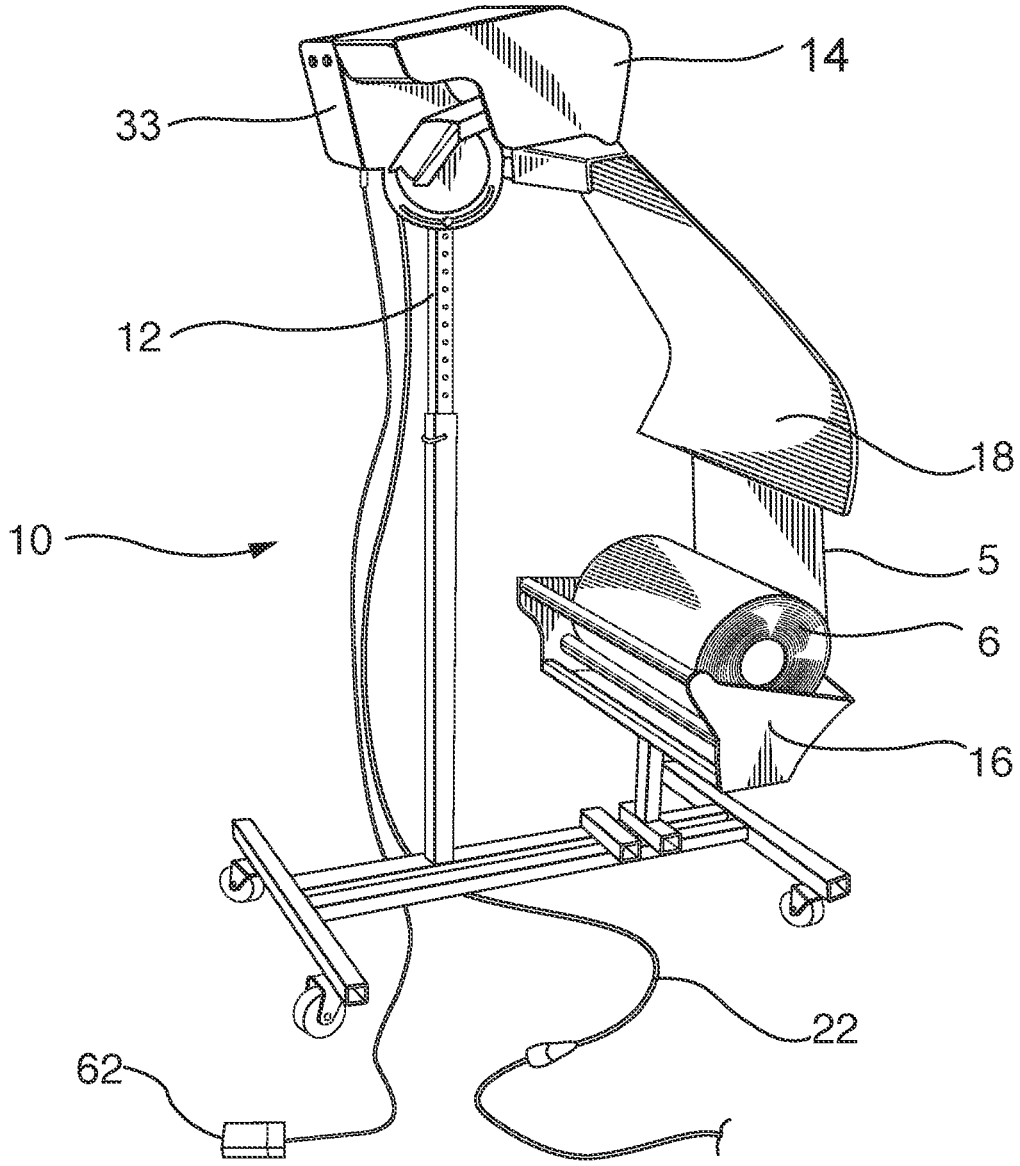
FIG. 1 is a front view of the paper crumpling machine, or paper crumpler.
Figure 2:
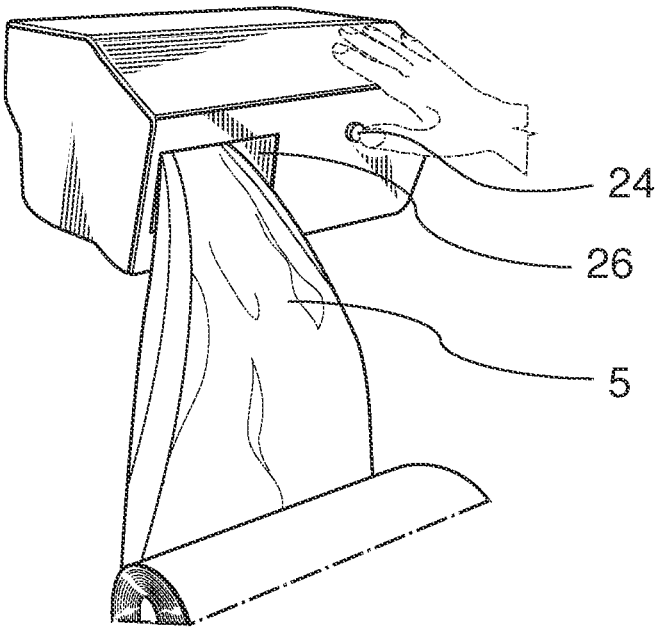
FIG. 2 is a view of the input side of the paper crumpler.
Figure 3:
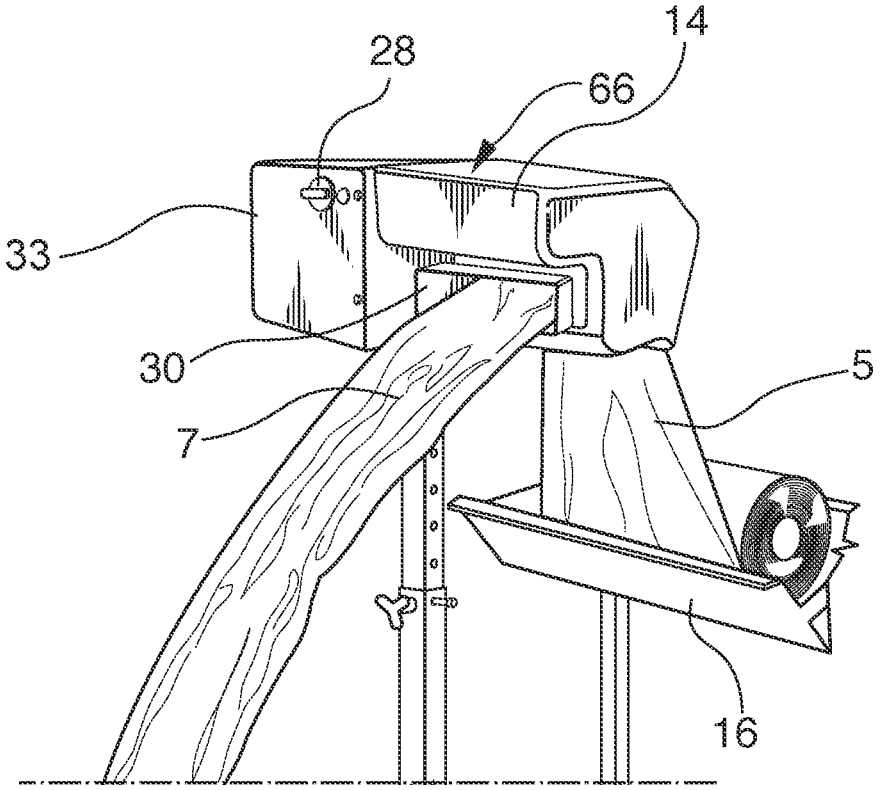
FIG. 3 is a perspective view of the feed side of the paper crumpler.
Figure 4:
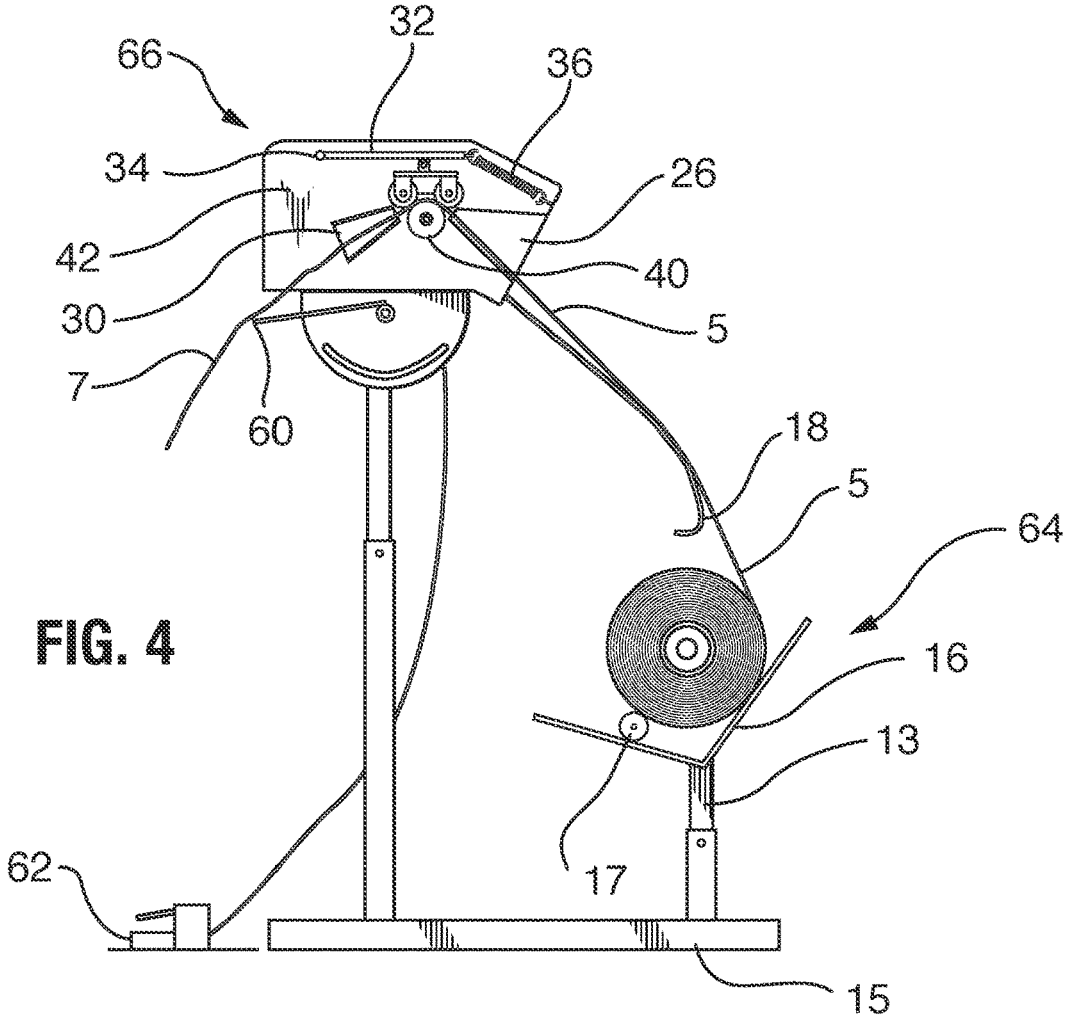
FIG. 4 is another front view of the paper crumpler with the front cover removed.
Figure 5:
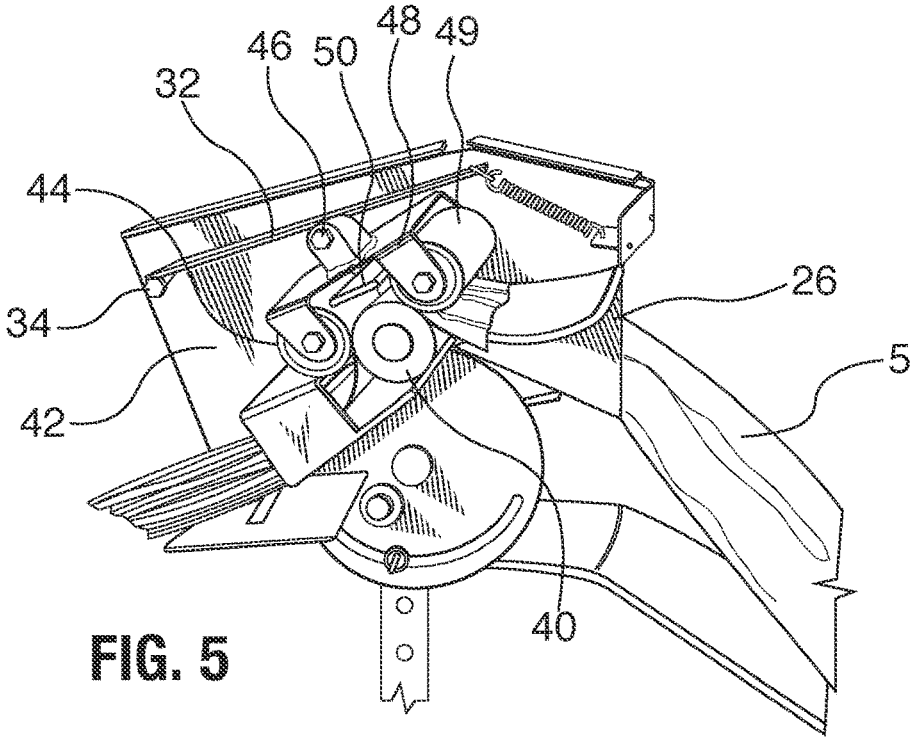
FIG. 5 is close in front view of the paper crumpler.
Figure 6:
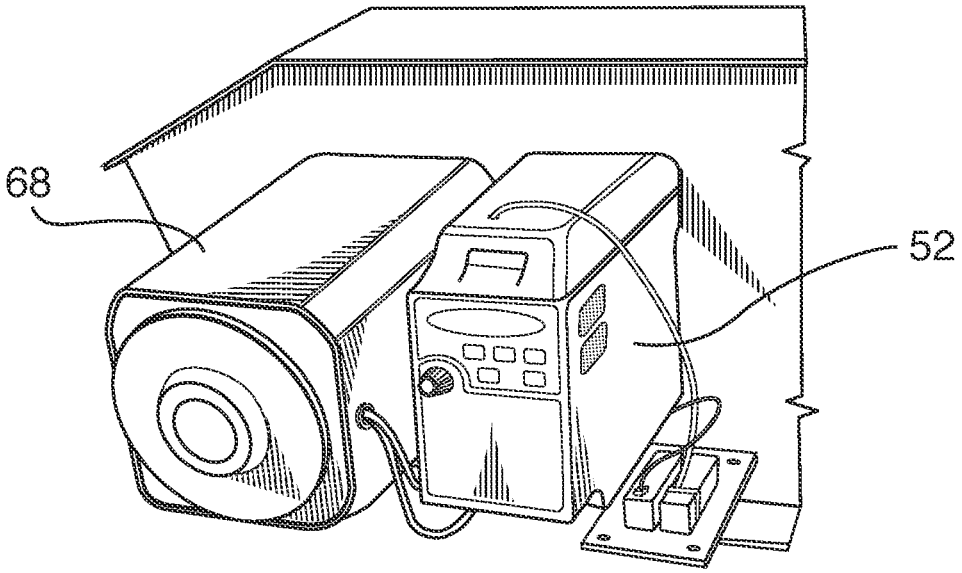
FIG. 6 is a rear view of the paper crumpler with the cover removed.
Figure 7:
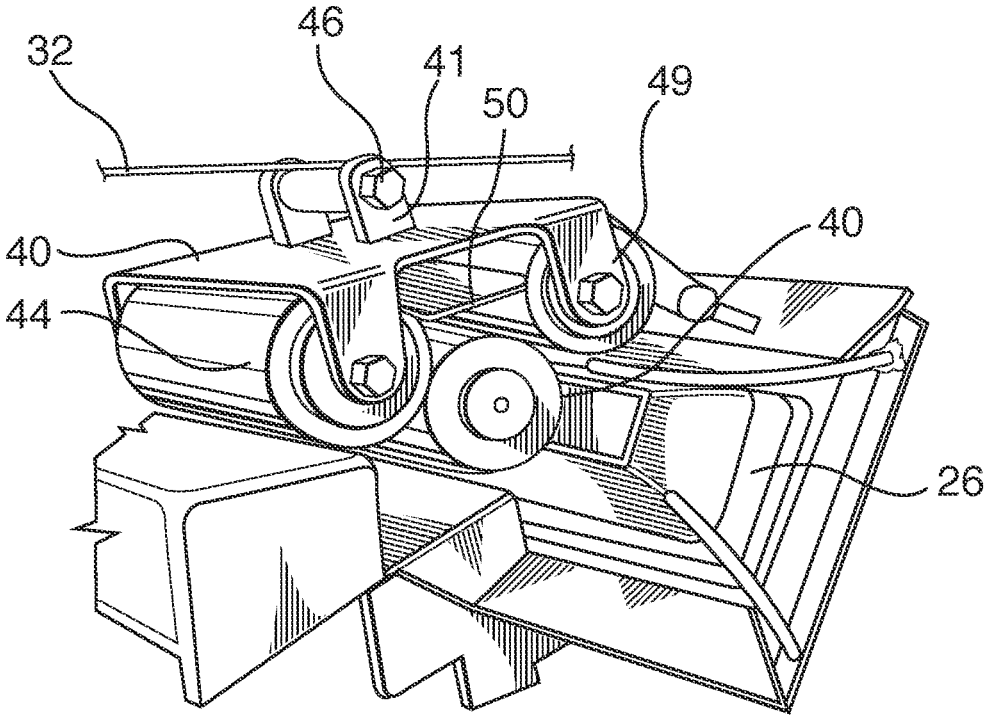
FIG. 7 is another close in front view of the paper crumpler.
Figure 8:
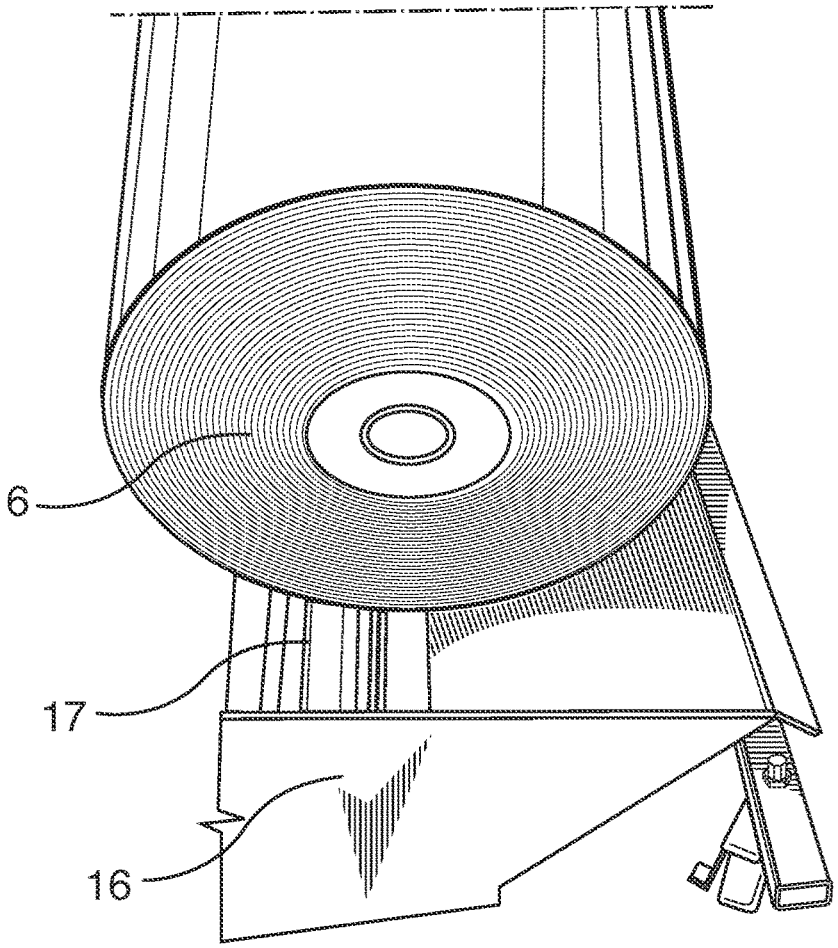
FIG. 8 is view of the paper roll in the unrolling section.
Figure 9:
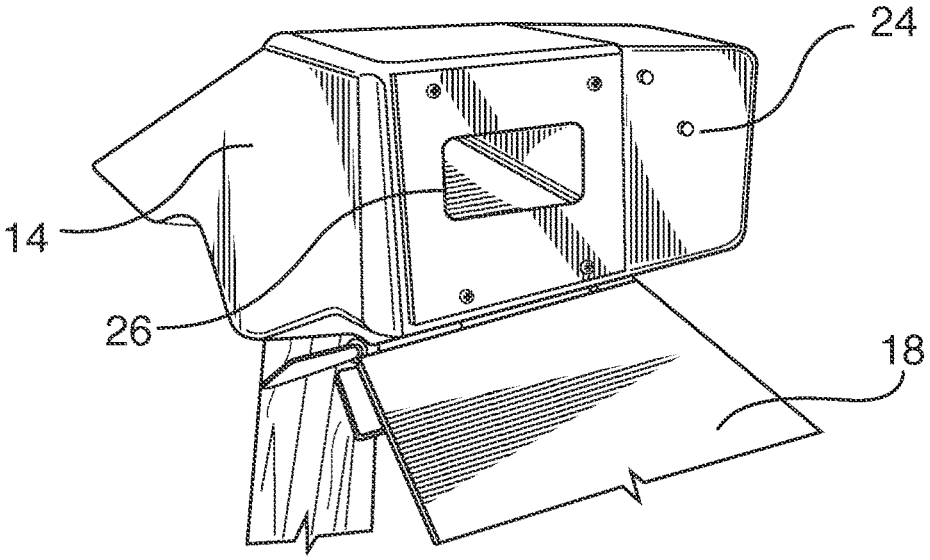
FIG. 9 is a left side view of the paper crumpler showing the outfeed section.
Figure 10:
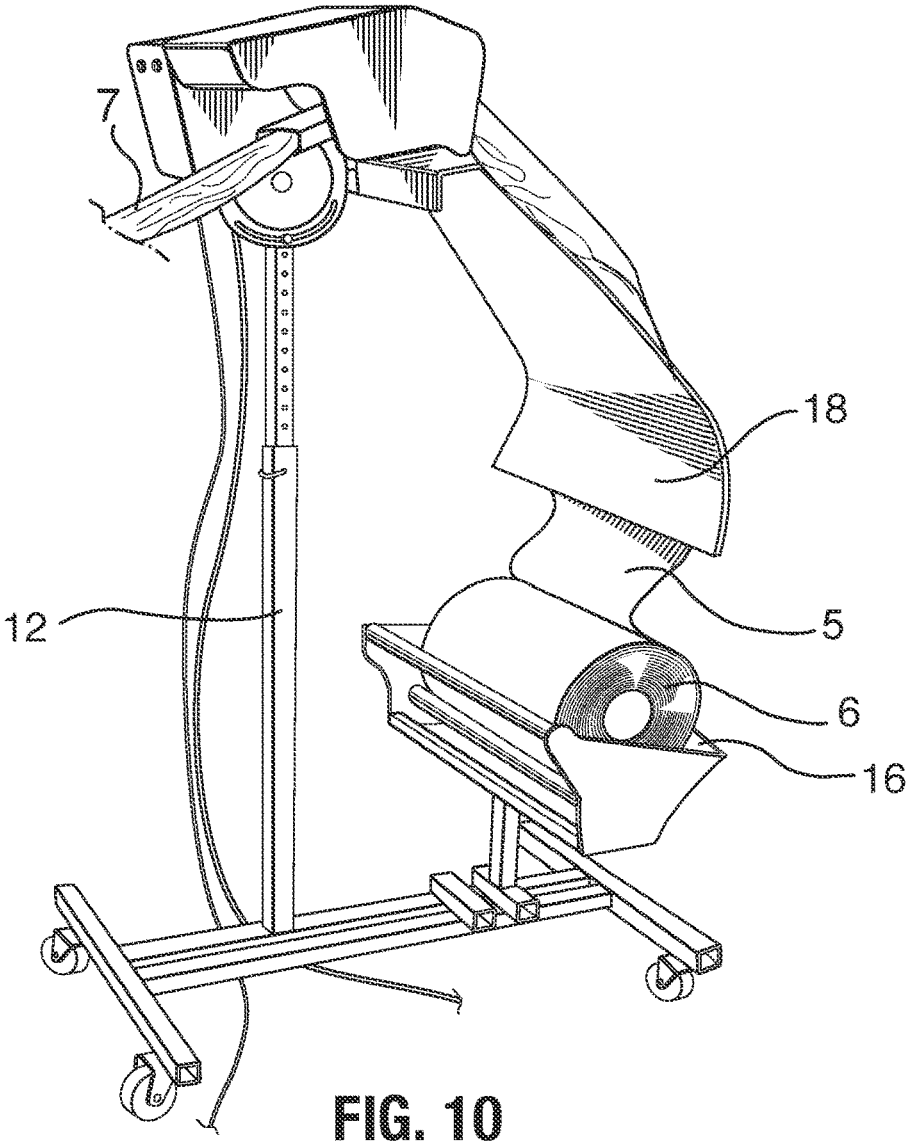
FIG. 10 is another front view of the paper crumpler.
Figure 11:
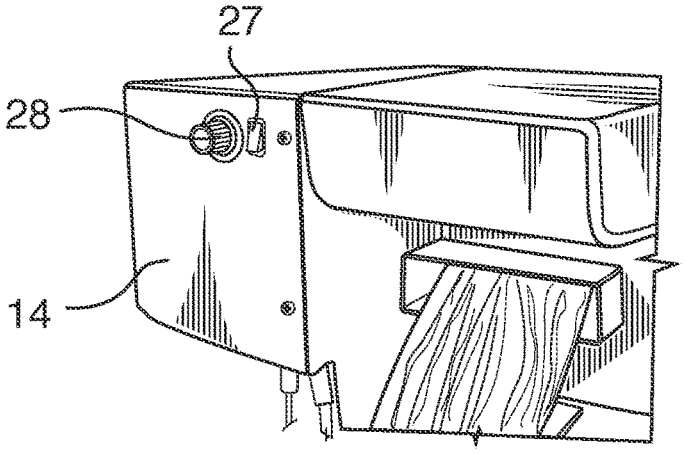
FIG. 11 is another view of the outfeed section of the paper crumpler.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. References to "front," "back," "rear," "upper," "lower," "right," and "left" are used to identify the various elements to a user facing the sink, and with "lateral" being left-right.

It should further be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "about" can be reasonably appreciated by a person skilled in the art to denote somewhat above or somewhat below the stated numerical value, to within a range of ±10%.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In accordance with the present invention, there is provided a paper crumpling machine 10 a floor stand 15 with a first vertical pedestal 12 supporting the paper crumpling device and a second vertical pedestal 13 supporting a paper unrolling section. The height of each of the two pedistals is adjustable. The first pedestal 12 supports the paper crumpler 66 at a height of two to three feet above the unrolling section 64. The first pedestal 12 holds the paper crumpler 66 about five feet from the floor.

The floor stand 15 sits flat on a selected floor space. Alternatively, the stand 15 is fitted with wheels for portability. The paper crumbler assembly 66 is supported by pedestal 12 and includes a motor controller 52 and motor 68 mounted on one side of a vertical back plate 42 covered by housing 33 and the paper crumbling assembly is mounted on the opposing side of the back plate 42 covered by housing 14.

The paper crumpler section 66 includes an feed horn 26 which has a rectangular opening. The open end of feed horn 26 about six inches wide and about four inches high with smooth curved edges around the opening. The exit end of the feed horn 26 is about five inches wide and about one inch high.

Passing through the feed horn, the feed sheet 5 encounters a motor driven neoprene covered horizontal roller 40 and a neoprene covered horizontal idler roller 49. The idler 49 is pressed against the driven roller 40 by a rocker plate 41 which holds the first idler 49 and the second idler 44 horizontally against the driven roller 49. The two idlers 49 and 44 are spaced apart so that idler 49 contacts the driven roller 40 at about 1:30 (the angle made by the minute hand on an analog watch at the hour of one thirty) with respect to driven roller 40 and idler 44 contacts driven roller 40 at about 9:00 with respect to the driven roller 40. The rocker plate 48 is rotatably connected to the bottom surface of a pressure plate 32 by pivot pin 46 and is pivotally connected at the left end to the back wall 42 by a pin 34 and to an extension spring 36 at the right end. The free end of the spring 36 extends to the right and downward at about fifteen degrees below horizontal and is attached to a pin above the open end of the feed horn 26, with the spring tensioned to maintain contact of both idlers 49 and 44 against the driven roller 40 with enough force to cause the paper to be pulled form the paper roll 6 when paper 5 is fed through the feed horn 26 and on between idler 49 and roller 40 while the roller 40 is driven. There is a paper diverter plate 50 between the idler rollers which causes the paper to initially be diverted downward when threading the paper into the machine.

As the paper is runs between the idler 44 and drive roller 40, the paper enters and exits the discharge chute 30 and exits the machine. Below the dischute chute is a pivotally adjustable knife 60 which can be used by an operator to drag the crumpled paper 7 against and tear a piece off. Having the idler rollers 44 and 49 on each side of the drive roller improves the control and gives a firm drive force to the paper. The drive roller 40 and the two idlers 44 and 49 are about seven inches wide.

Mounted on the back side of the back wall 42 is the motor controller 52. Inputs to the motor controller are the speed select dial 28, the power on switch 27, the paper feed button 24, the electric power cord 22, and the foot feed button 62. On the left side of the paper crumpler 66 is the speed select dial 28 and a power on button 27. On the right side of the paper crumpler 66 is a paper feed button 24. The foot feed switch is on the floor. The output of the motor controller drives the motor 68. The driven roller 40 is mounted directly to the drive shaft of the motor 68. The motor 68 only runs when the foot feed switch 62 or the paper feed switch 24 is pressed. The motor is stopped at all other times.

An feed guide plate 18 guides the paper up to the feed horn 26. The guide plate 18 applies drag to help control the paper as the paper speeds up or comes to a rest when the motor stops. The vertical center of the guide plate 18 is curved outward into the paper to enhance drag.

The roll of paper is cradled against an idler roller 17 and against the support wall 16 of the paper tray unrolling section 64.

To thread the roll of paper, facing the front of the paper crumpling machine, lay the roll 6 of paper in the unrolling section 64 so that as the paper is pulled, the roll 6 will roll counter-clockwise. Pull the free end of paper upward and fold or crumple the end of the paper. Push and hold the paper feed button 24 and insert the crumpled end of the paper into and through the feed horn 26. The end of the paper will be pulled between the idler roller 49 and the driven roller 40. The paper is pushed into the underside of the diverter plate 50 and on between the idler 44 and the driven roller 40. The paper is pushed on through the outfeed horn 30 down past the knife 60. Now the operator can walk to the left or outfeed side of the paper crumpling machine. The operator can now step on the foot feed switch 62 to feed a selected amount of crumpled paper out. The paper is now dragged down against the knife edge and is torn.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A paper crumpling machine comprising:

a floor stand with a first vertical pedestal and a second vertical pedestal;

said first pedestal supporting a paper crumpler, said paper crumpler having a housing having a front side, a back side, a left side and a right side, said paper crumpler having a feed horn having a rectangular conical feed opening extending inward in flow communication with a driven roller and a first idler roller, said drive roller fixed on an output shaft of a motor, said first idler roller rotatably connected to a rocker plate, said rocker plate pivotally connected to a bottom surface of a pressure plate having an end pivotally connected to a vertical back plate of said paper crumpler and an opposing end of said pressure plate connected to a first end of an extension spring extending downward at a selected angle connected to a pin extending from said back plate said rocker plate having a second idler roller rotatably connected thereto and pressing against said driven roller, said first idler roller and said second idler roller spaced apart on said rocker plate at selected angles with respect to said drive roller, said rocker plate including a diverter plate extending from said first idler roller toward said second idler roller, said paper crumpler having a discharge chute opening facing between said drive roller and said second idler roller, said motor attached on a rear side of said back plate, a motor controller attached to said rear side of said back plate, said motor controller having a power on switch, a speed select switch, a paper feed switch, and a foot feed switch electrically connected thereto;

said second vertical pedestal having a paper feed roll cradle fixed thereto comprising a first plate with a planar surface extending outward at a selected angle above horizontal and a free rolling idler roller spaced apart therefrom, whereby the frictional dampening between said planar surface and a roll of paper serves to keep the speed of unrolling paper under control and prevent said roll of paper from feeding out loose paper while coasting to a stop;

and a feed paper guide hanging down from a bottom edge of said feed horn, said feed paper guide curving upward into a path of feed paper flow and providing frictional dampening against a bottom surface of feed paper.

2. A paper crumpling apparatus comprising:

a) a base supporting a paper crumpling machine;

b) a paper roll cradle mounting to said base, said paper roll cradle including a paper tray with a planar surface extending outward at a selected angle above horizontal and a free rolling idler roller spaced apart therefrom for supporting a roll of said feed paper there between for supplying a ribbon or sheet of said feed paper; and c) said paper crumpling machine, comprising:

a motor, a motor controller attaching to a back plate, a power switch, a speed select switch, a paper feed switch, and a foot feed switch electrically connected thereto;

a feed horn with an opening for receiving a sheet or ribbon of feed paper;

a first idler roller, a second idler roller, and a drive roller;

said first idler roller and said second idler roller rotatably connected to a rocker plate and spaced apart positioned above and in contact said drive roller;

said rocker plate rotatably connecting to a bottom surface of a pressure plate having an end pivotally connecting to a vertical back plate of said paper crumpler, and an opposing end of said pressure plate connecting to a first end of an extension spring and a second end of said extension spring extending downward at a selected angle and connected to a pin extending from said back plate, said spring tensioned to bias said first idler roller against said drive roller;

said second idler roller rotatably connecting to said rocker plate pressing against said drive roller and said feed paper threaded there between forming a crumpled paper;

said rocker plate including a diverter plate extending between said first idler roller and said second idler roller and above said drive roller for directing said paper feed between said drive roller and said rear idler roller;

a crumpled paper discharge chute in alignment with said second idler roller and said drive roller and in flow communication with said crumpled paper; and means for cutting said crumpled paper exiting said crumpled paper discharge chute.

3. The paper crumpling apparatus of claim 2, further including a detachable paper feed dampener extending from said feed horn, said detachable paper feed dampener having a free distal end for flexing and dampening said paper feed ribbon or sheet feeding from said paper roll.

4. The paper crumpling apparatus of claim 3, wherein a proximate end of said detachable paper feed dampener includes an adjustable arm extending from a selected position near a proximate end of said detachable feed dampener, said adjustable arm permitting limited flexing of said feed dampener and positioning of the said distal end of the said paper dampener for alignment with said paper feed ribbon sheet pulled from said paper roll.

5. The paper crumpling apparatus of claim 2, wherein said paper crumpling machine is mounted on a first pedestal extending from said base and said paper roll cradle is mounted on a second pedestal extending from said base.

6. The paper crumpling apparatus of claim 2, wherein said first idler roller and said second idler roller are spaced apart and angled to increase the surface area of feed paper contacting said drive roller.

7. The paper crumpling apparatus of claim 2, further including a paper roll cradle having a first plate with a planar surface extending outward at a selected angle above horizontal and a free rolling idler roller whereby the friction between said planar surface and a roll of paper serves to keep the speed of unrolling paper under control and prevent said roll of paper from feeding out loose paper while coasting to a stop.

8. The paper crumpling apparatus of claim 2, wherein said knife is pivotally adjustable.

9. The paper crumpling apparatus of claim 2, wherein said first pedestal and said second pedestal are mounted to a base.

10. The paper crumpling apparatus of claim 9, wherein said base includes wheels.

11. The paper crumpling apparatus of claim 2, wherein a vertical center of said guide plate is curved outward into the paper path to enhance drag.

12. The paper crumpling apparatus of claim 2, wherein said drive roller and said idler rollers are covered with NEOPRENE.

13. A method for crumpling paper comprising the steps of:

feeding a sheet of paper from a roll into a paper crumbling apparatus comprising:

a support stand extending from a base, said stand including means for adjusting its height; a frame pivotally attaching to said support stand; said frame including a housing; said frame including a generally vertical support plate disposed within said housing; said support plate including a first side including an electric motor and means of controlling said motor; said support plate including a roller assembly affixed to a second side in cooperative engagement with said electric motor, said roller assembly including a pressure plate pivotally mounting to said second side of said support plate, said pressure plate exerting downward pressure due to biasing means in cooperative engagement therewith mounting to said support plate; a rocker plate pivotally mounting below said pressure plate supports said roller assembly; said roller assembly including a front idler roller mounting thereto and a rear idler roller spaced apart therefrom, a drive roller spaced apart from and disposed between said rear idler roller and said front idler roller, and a diverter plate mounting to said rocker plate between said rear idler roller and said front idler roller spaced a selected distance above said drive roller; said housing including a front feed chute and rear discharge chute on flow communication with said roller assembly; a detachable paper feed dampener projecting forward and tilting downward at a selected angle from said feed housing below said feed chute, said detachable paper feed dampener having an inwardly curving end portion for supporting and guiding a feed paper sheet into said feed chute, said feed dampener imparting frictional drag to said feed paper sheet; and a paper tray for supporting a roll of paper spaced apart from and in alignment with said detachable paper feed dampener;

pulling said paper sheet from said paper roll forward slightly to redistribute its weight on a top surface of said paper idler cylinder minimizing contact of said paper roll with said panel;

allowing said paper roll to rock back against said panel upon ceasing pulling of paper sheet from said paper roll imparting drag on said paper roll preventing freewheeling and bird nesting of said paper roll by braking said paper feed roll.

14. The method for crumpling paper of claim 13, including the step of coating said front panel with a friction enhancing coating.

15. The method for crumpling paper of claim 13, including the step of supporting a roll of paper on said paper idler roller against said front panel in a rest position and said pulling said paper roll over said paper idler roller spacing the roll of paper apart slightly from said front panel during rotation.

* * * * *